US007044844B2

(12) United States Patent
Caporusso

(10) Patent No.: US 7,044,844 B2
(45) **Date of Patent: *May 16, 2006**

(54) SHAPING PULLEY ASSEMBLY FOR BELT NOTCHING MACHINE

(75) Inventor: Alessandro Caporusso, Piedimonte San Germano (IT)

(73) Assignee: CML International S.p.A., Piedimonte S.G. (IT)

( * ) Notice: Subject to any disclaimer, the term of this patent is extended or adjusted under 35 U.S.C. 154(b) by 4 days.

This patent is subject to a terminal disclaimer.

(21) Appl. No.: 10/969,180

(22) Filed: Oct. 21, 2004

(65) Prior Publication Data

US 2005/0059326 A1 Mar. 17, 2005

Related U.S. Application Data

(62) Division of application No. 10/678,218, filed on Oct. 6, 2003, now Pat. No. 6,855,038.

(30) Foreign Application Priority Data

Oct. 4, 2002 (IT) ..... RM2002A0499

(51) Int. Cl.
*B24B 21/20* (2006.01)

(52) U.S. Cl. ..... 451/311; 451/297

(58) Field of Classification Search ..... 451/311, 451/296, 297

See application file for complete search history.

(56) References Cited

U.S. PATENT DOCUMENTS

| | | | | |
|---|---|---|---|---|
| 294,766 | A | 3/1884 | Coy | |
| 344,835 | A | 7/1886 | Hollister | 451/311 |
| 1,622,758 | A | 3/1927 | Beulke et al. | |
| 1,784,848 | A | 12/1930 | Reichle | |
| 1,999,275 | A | 4/1935 | Bertrand | |
| 4,421,228 | A | 12/1983 | Marsiglio et al. | |
| 5,048,661 | A | 9/1991 | Toye | |
| 5,357,714 | A | 10/1994 | Landhuis | 451/311 |
| 5,421,441 | A | 6/1995 | Mason | |
| 5,437,570 | A | 8/1995 | Landhuis | 451/296 |
| 5,597,135 | A | 1/1997 | Vandersteene | |
| 6,419,569 | B1 | 7/2002 | Frech et al. | |
| 6,663,475 | B1 | 12/2003 | Price | |
| 6,733,372 | B1 | 5/2004 | Lin | |
| 6,855,038 | B1 | 2/2005 | Caporusso | |
| 2001/0014577 | A1 | 8/2001 | Frech et al. | |

FOREIGN PATENT DOCUMENTS

| | | |
|---|---|---|
| DE | 413 1523 A1 | 4/1993 |
| DE | 295 04 077 | 4/1995 |
| EP | 488688 A2 | 6/1992 |
| WO | 03/022481 A1 | 3/2003 |

*Primary Examiner*—David B. Thomas
(74) *Attorney, Agent, or Firm*—Foley & Lardner LLP

(57) ABSTRACT

A shaping pulley assembly (6) for a belt notching machine, including on a frame (1) a pair of driving and shaping pulleys (3, 4) for a grinding belt (5), includes a shaping pulley holder element (9) like a fork supported by the frame (1), having a C-shaped body with end brackets (90, 91), a stationary center and a removable counter-center, both being live centers which are housed in respective housings of the end brackets (90, 91), a shaping pulley (4) in the form of a cylindrical roller provided with center holes (42, 43) opposite to each other for fixed centre and removable counter-center, respectively on the bases (40, 41) of the shaping pulley.

20 Claims, 2 Drawing Sheets

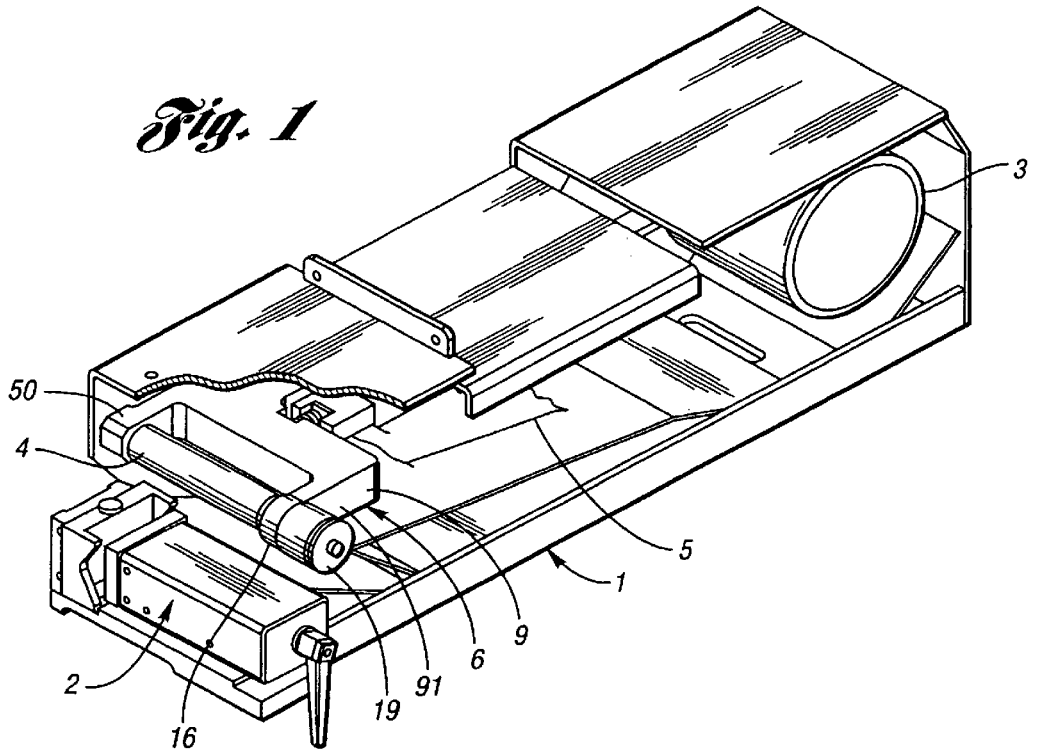
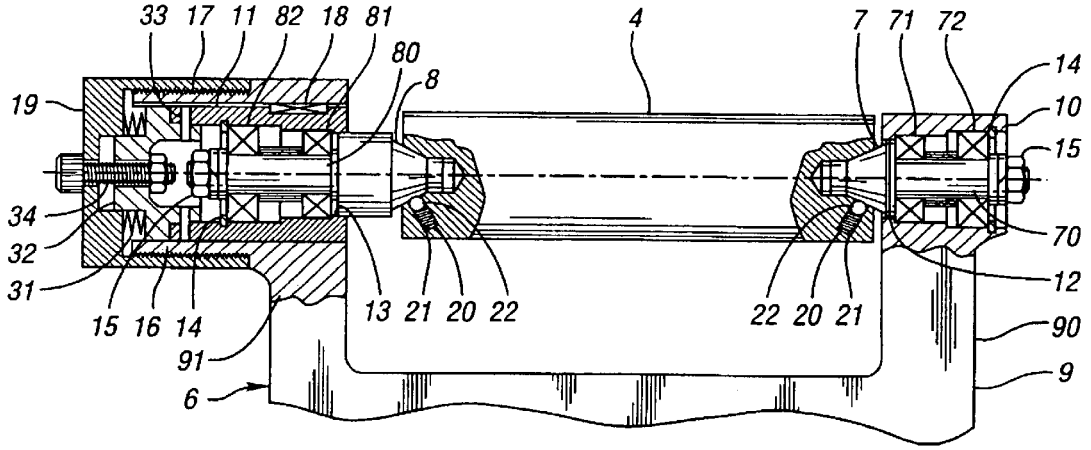
Fig. 2

SHAPING PULLEY ASSEMBLY FOR BELT NOTCHING MACHINE

CROSS REFERENCE TO RELATED APPLICATIONS

This application is a division of application Ser. No. 10/678,218. filed on Oct. 6, 2003 now U.S. Pat. No. 6,855, 038 the entire contents of which are hereby incorporated by reference.

TECHNICAL FIELD

This invention relates to a shaping pulley assembly for belt notching machine. While it will be referred below only to a belt notching machine, it should be appreciated that the subject-matter of the invention can be applied in the same way to other machines operating through a grinding belt, such as buffing machines, linishers, honing machines, and polishing machines.

A notching machine is a grinding machine for shaping or recessing the ends of tubular workpieces and/or solid sections. The notching machine includes a pair of pulleys and a grinding belt passing around the pulleys: one of the pulleys is a driving pulley for the grinding belt, and the other pulley is a shaping pulley co-operating with the grinding belt to shape recesses. A device for clamping a tubular workpiece or a solid section is located near the shaping pulley and is movable towards and away from the shaping pulley. The shaping pulley, being in general of a diameter equal or close to the diameter of the tubular workpiece, is interchangeable in order to permit differently sized recesses to be performed.

BACKGROUND ART

In prior art notching machines it has been attempted to achieve that a shaping pulley is installed and removed easily and expeditiously in order to obtain, through a manual operation, a replacement of a pulley by another one with different diameter, with a result that differently sized recesses can be performed.

Among others, U.S. Pat. No. 5,357,714 granted to Landhuis on Oct. 25, 1994 discloses an apparatus for grinding recesses, wherein a shaping pulley has a through shaft with races for ball bearings. The one end of the through shaft of the shaping pulley is inserted in a hole, and the opposite end of the shaft is pushed into a fork provided with stop means, the hole and the fork being performed in side walls of the apparatus respectively. In the side walls, internally, there are pivotally put two pairs of ball bearings, respectively, which are designed to engage said races in the shaft of the shaping pulley. The arrangement of this shaping pulley on the grinding machine requires accurately machined surfaces for the coupling of the races in the shaft with the pairs of ball bearings. Further, a great number of components is required.

U.S. Pat. No. 5,437,570, also granted to Landhuis on Aug. 1, 1995 discloses an apparatus for grinding recesses, wherein a shaping pulley has a shaft section on both its sides. Each shaft section is provided with a coaxial bearing element that is designed to be received and locked into tapered housings internally formed in respective side walls of the apparatus. One should appreciate that the above mentioned disposition requires that each shaping pulley is provided with a couple of ball bearings being of an internal diameter corresponding to the diameter of the shaft sections.

Furthermore, in an apparatus for grinding recesses or notching machine with ready replacement of its shaping pulley according to the previous patent application PCT No. 01/00469 of the same inventor, a supporting device for a shaping pulley, which has shaft sections in its opposite ends, is provided with rest bushings housing a rolling bearing for receiving a respective shaft section of said shaft sections of the shaping pulley, rest bushings that are mounted on a movable assembly connected to the frame of the notching machine by means of a clamping element to the frame of the apparatus.

In the prior art notching machines the supporting device for a shaping pulley is mounted on open rolling bearings, i.e. without any protection. Therefore, these open rolling bearings, which are further subjected to the vibrations generated at high speeds as well as to the contaminating action of chips and wastes due to the wear of the grinding belt in its operation, tend to be damaged easily and to have a short life, with a consequence of rise in costs and in waste of time for an operator of the machine. As a result, each rolling bearing on the ends of the shaping pulling is affected in a particularly considerable way, with equal grinding belt and same number of revolutions per minute of the driving pulley, when the idle shaping pulley is of a very small diameter to grind corresponding recesses, the rotation speed of the shaping pulley increasing in inverse proportion with a decrease of its diameter.

An object of the present invention is to permit the location of the shaping pulley in a notching machine without any risk of blocking due to a failure of its support rolling bearings.

DISCLOSURE OF THE INVENTION

A shaping pulley assembly is more fully disclosed in Italian Patent RM2002A0499, entitled "Shaping Pulley Assembly for Belt Notching Machine" which is commonly assigned and incorporated herein. The present invention provides a shaping pulley assembly for a belt notching machine, including on a frame a pair of pulleys carrying a grinding belt, the one of the pulleys being a driving pulley for the grinding belt, and the other one being a shaping pulley that is interchangeably mounted on the frame to co-operate with the grinding belt for forming differently sized recesses in tubular workpieces and/or solid sections, characterized in that the shaping pulley assembly comprises:

a shaping pulley holder element like a fork supported by the frame, having a C-shaped body with end brackets, one of which is provided with a housing coaxial to another housing in the other end bracket, a stationary centre and a removable counter-centre, both being live centres which are housed in the respective said housings of stationary centre and removable counter-centre;

an idle shaping pulley in the form of a cylindrical roller, which is provided with centre holes opposite to each other for said fixed centre and said removable counter-centre, respectively on the bases of the shaping pulley.

It should be appreciated that the pulley assembly according to the present invention permits a shaping pulley of a notching machine to be located in an easy and quick way.

Advantageously, the pulley assembly according to the invention has the typical feature of a system with opposite live centres, i.e. the self-centring feature. Further, the system with opposite live centres, as it permits, differently from the prior art, the support of the shaping pulley on a double pair of rolling bearings, allows for smaller shafts to be used with respect to the prior art. As a positive consequence, the arrangement with pairs of rolling bearings allows higher speeds with less vibrations and more durability with respect to the prior art.

Further, the number of components of the support of the shaping pulley is reduced because each pulley, independently of its diameter, can be mounted on the same opposite live centres provided that all the pulleys have the same centre hole.

Yet, as the pulley is made in the form of a preferably solid roller, all the shaping pulley assembly has a great rigidity.

The invention will be described below with reference to embodiments thereof with connection to the enclosed drawing, in which:

BRIEF DESCRIPTION OF THE DRAWING

FIG. 1 is a fragmentary perspective view of a notching machine using a shaping pulley assembly according to the present invention;

FIG. 2 is an enlarged, partially axially sectioned top view of the shaping pulley assembly in FIG. 1;

DETAILED DESCRIPTION OF THE SEVERAL EMBODIMENT

Figure 3:
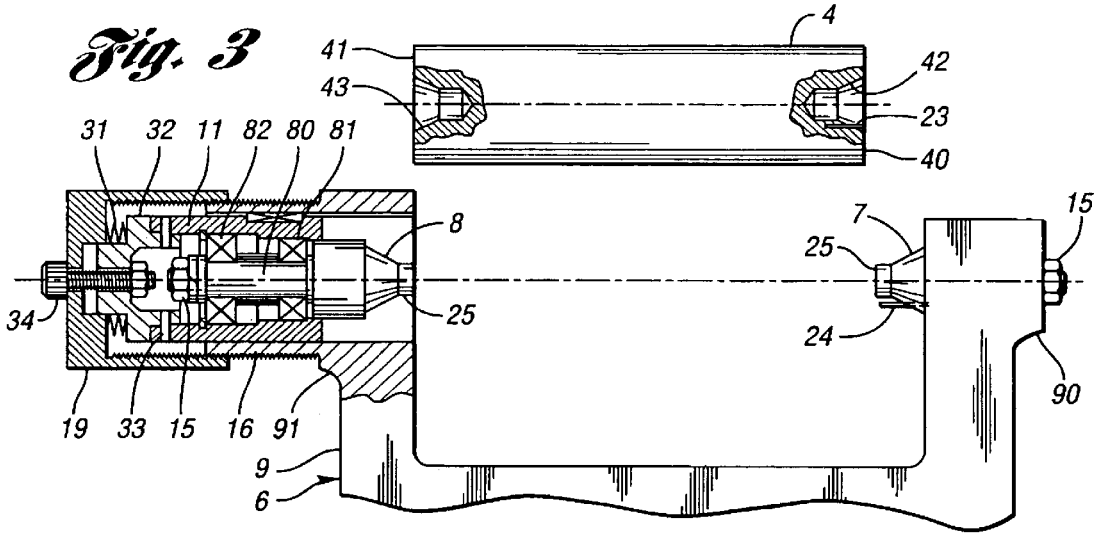
FIG. 3 is a top view, similar to that of FIG. 2, with the shaping pulley being removed from the assembly thereof.

First with reference to FIG. 1, a notching machine provided with a shaping pulley assembly according to the present invention is shown therein in a fragmentary perspective view. In FIG. 1 a frame is designed in general as 1, and a vice for a tubular workpiece, that is shown without its support base on frame 1, is designed as 2.

A pair of pulleys 3, 4 carry a grinding belt 5. The pulley 3 is a driving pulley for the grinding belt 5, and the pulley 4 is a shaping pulley co-operating with the grinding belt 5 to make recesses conventionally in a not shown tubular workpiece (not shown).

The shaping pulley 4 is interchangeable with other pulleys of different diameter (not shown) so to permit that differently sized recesses can be performed.

According to the invention, as best shown in FIGS. 2 to 5, which are fragmentary plan views of the shaping pulley assembly, the shaping pulley 4 is a part of a shaping pulley assembly generally designed as 6. The shaping pulley 4 is in the form of a preferably solid, cylindrical roller, having bases 40, 41 in which opposite centre holes 42, 43 are formed (as shown in FIG. 3). The centre holes, like the centre holes that are performed on heads of workpieces designed to be supported in the working operations on machine tools, can be of a standard type. In the embodiment shown the centre holes have a frustoconical section with a taper of 60 degrees internally ending with a cylindrical section being of a diameter equal to the diameter of the minor base of the frustoconical section.

Inserted in the centre holes 42 and 43 are a centre and a counter-centre, which in all the figures, also if modified, are denoted generally in 7, and 8 respectively. The centre 7 and the counter-centre 8 are live centres (or centre spindles) and are supported in the shaping pulley assembly 6 by a pulley holder element 9 like a fork. The pulley holder element 9, which is supported by the frame 1 in a conventional way, has a C-shaped body with end brackets 90, 91. Each of the brackets 90, 91 is provided with a housing for rolling bearings that are selected to withstand both radial and axial loads to which the centres each to other opposite are subjected. The two housings on the brackets 90, 91 are mutually axial. In particular, provided on the bracket 90, on the centre side, is a race 10 where the centre 7 is stationary mounted, and on the bracket 91, on the counter-centre side, a seat 11 (or housing) is inserted in which the counter-centre 8 is removably mounted.

As shown in FIGS. 2 to 5, between the shaping pulley 4 and at least one of the centre 7 and the counter-centre 8 there are provided retaining means that causes centre and counter-centre to rotate when the shaping pulley 4 is going to rotate in virtue of the grinding belt 5 which is driven by the driving pulley 3.

With respect to said retaining means, as shown in particular in FIG. 2, holes 20 at right angles to the frustoconical surface of the centre holes 42, 43, as seats of helical springs 21, are formed the pulley 4. The springs 21 charge a ball 22 against a recess which is correspondingly formed on the frustoconical surface of a centre 7 and a counter-centre 8.

Referring to FIG. 3, a hole 23 parallel to the axis of the pulley 4 is formed in the hole 42 of the pulley 4 for a pin 24 which is integral with the centre 7 in a corresponding way.

Figure 4:
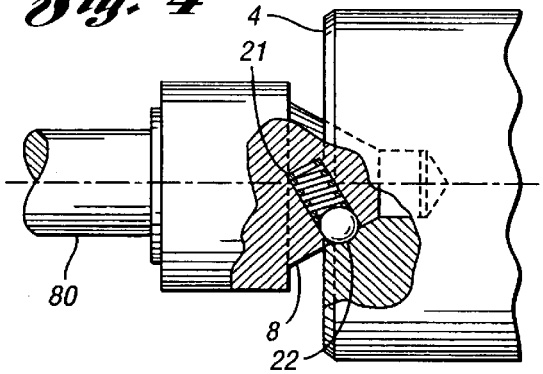
FIG. 4 is a fragmentary top view, similar to that in FIG. 3, which is limited to a first embodiment of a centre retaining means.
Figure 5:
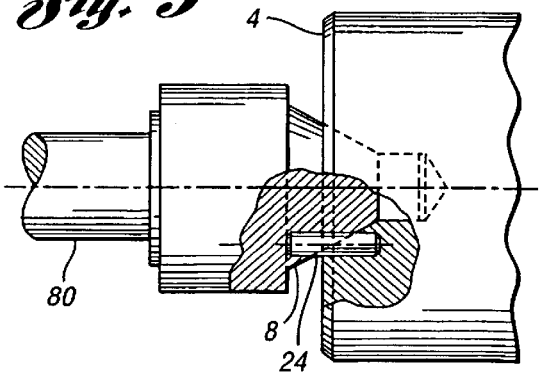
FIG. 5 is a fragmentary top view, similar to that in FIG. 3, which is limited to a second embodiment of a centre retaining means.

The same pin retaining means of FIG. 3 is shown in an opposite location in the counter-centre 8 (FIG. 5), and the retaining means having a spring charged ball, in an inverted position (the seat for helical spring and ball is made in the counter-centre 8, not in the pulley 4) is shown in FIG. 4. It is obvious that the same retaining means can be applied to the centre.

Likewise it is evident that the retaining means can be different, but mechanically equivalent, or they could not be necessary if the friction between the contacting surfaces of centre and counter-centre and the surfaces of the respective holes 42, 43 (i.e., the contacting surfaces carried out in the idle shaping pulley) is enough to let said centre and counter-centre to rotate together with the shaping pulley.

Advantageously to improve their centring, the centre 7 and the counter-centre 8 include in addition to a common frustoconical portion, in their free end a cylindrical portion which is denoted in 25 for the support in respective centre holes. The cylindrical portion 25 could be useful in case a thrust on centre and counter-centre is accidentally reduced, if the frustoconical portion of the same should be no longer in contact with the respective centre holes.

It is evident that the frustoconical centre could be made with less convenience, instead on the supports of the shaping pulley, in the bases of the same shaping pulley in order to engage holes which are correspondingly carried out in the support of the pulley holder element.

Referring again to FIGS. 2 and 3, the stationary centre 7 and the removable counter-centre 8 are explained in details. Both the centre 7 and the counter-centre 8 have a small shaft 70, 80 supported by a pair of radial (71, 81) and axial (72, 82) rolling bearings, which are spaced apart by a spacer. The roller bearings 71, 72 and 81, 82 are retained on the shaft and inside the respective seats of centre 10 and counter-centre 11 by means of an abutting shoulder 12, 13 and an axially fit Seeger type retaining ring 14 and a nut 15.

In order to permit the movable counter-centre to slide, the housing 11 thereof is made in the form of a cylindrical element which is mounted able to slide inside an hollow, cylindrical, externally threaded enlargement 16 which is carried out on the end bracket 91 of the pulley holder element 9 at right angles to the bracket 91. The cylindrical element 11 is prevented to rotate e.g. by a key 18 sliding in its slot 17 which is carried out in the bracket 91. An internally threaded cap 19 is screwed on the hollow cylindrical enlargement 16 in abutment with the free end of the sliding cylindrical element 11 by axially interposing spring charge means, such as Belleville washers 31 abutted between the interior of the cap and an internal counter-cap 32. The spring charge means serves to keep the pulley firmly engaged between centre and counter-centre, notwithstanding the stresses acting on the pulley.

The internal counter-cap 32 is fixed on one side thereof to the cylindrical element 11 by pins 33, and it is connected on the other side thereof in a sliding way to the cap 19 e.g. by a bolt 34.

In such a way when a shaping pulley 4 is mounted on the fork-shaped pulley holder element 9 (FIG. 3) the cap 19 is easily screwed to cylindrical enlargement 16 of its bracket 91, after the shaping pulley 4 is located between centre 7 and counter-centre 8. By screwing the cap, the counter-centre 8, which is connected to the cylindrical element 11 as its housing, moves forward. After the screwing operation, the Belleville washers 31 assure a suitable pressure of the counter-centre 8 in the centre hole 43 of the shaping pulley 4. Vice versa the shaping pulley is removed by screwing the cap 19. In virtue of the internal counter cap 32, even if the cap 19 is screwed completely, the counter-centre 8 does not remain inside the pulley holder element 9 but it is drawn with it. It is evident that, if desired, this can be prevented without the provision of the counter-cap 32, by abutting the Belleville washers between the cap 19 and the cylindrical element 11 of the counter-centre 8.

Further it should be understood that the counter-centre engaging the shaping pulley could be driven by different means, e.g. such as lever means, bayonet means or the like, which for example could increase the replacement speed of the shaping pulley.

What is claimed is:

1. A belt notching machine, comprising: a drivable shaping pulley including at least one contacting surface defined on the shaping pulley;

a first and a second end bracket;

the first end brackets including a live centre;

the second end bracket including a slidably movable live counter-center, wherein the centre-centre are rotatable; and wherein the at least one contacting surface is configured in a manner to engage with any one of the live centre and the movable live counter-center.

2. The belt notching machine of claim 1, wherein the drivable shaping pulley has at least two contacting surfaces and wherein one of the contacting surfaces is positioned at an end of the shaping pulley and another of the contacting surfaces at an opposing end of the shaping pulley.

3. The belt notching machine of claim 2, wherein one of the two contacting surfaces engages the live centre and the other of the contacting surfaces engages the movable live counter-centre.

4. The belt notching machine of claim 1, wherein the live centre and live counter-centre include a frustoconical portion;

wherein an end of the frustoconical portion of the live centre and the frustoconical portion of the live counter-centre includes a cylindrical portion; and wherein the at least one contacting surface is configured to support the cylindrical portions of any one of the live centre and live counter-centre therein.

5. The belt notching machine of claim 1, wherein the live centre and live counter-centre include, a shaft;

at least one roller bearing configured in a manner to support the shaft and coupled to any one of the first and second end brackets;

wherein the roller bearings are coupled to the end brackets through at least one abutment shoulder and at least one retaining ring.

6. The belt notching machine of claim 5, wherein the at least one roller bearings is retained by the at least one abutment shoulder and at least one retaining ring.

7. The belt notching machine of claim 1, further comprising:

a retaining means provided with any one of the live centre and the live counter-center; wherein the retaining means is configured in a manner to secure the at least one contacting surface to any one of the live centre and the live counter-center so as to rotate any of the live centre and the live counter-center with the shaping pulley.

8. The belt notching machine of claim 7, wherein the retaining means includes a pin.

9. The belt notching machine of claim 7, wherein the retaining means includes a spring charged ball.

10. The belt notching machine of claim 1, further comprising:

a frame configured to support any one of the first end bracket and second end bracket.

11. The belt notching machine of claim 1, further comprising:

a first housing mounted with respect to the first end bracket and wherein the live centre is coupled to the first end bracket through the first housing; and a second housing mounted with respect to the second end bracket and wherein the live counter-centre is coupled to the second end bracket through the second housing.

12. The belt notching machine of claim 11, wherein the second housing includes a hollow cylindrical enlargement secured to the second end bracket;

a cap internally threaded and securable to the cylindrical enlargement; and a cylindrical element slidable with respect to the second end bracket; wherein said cylindrical enlargement is externally threaded in a manner to selectively couple the cylindrical element to the second housing.

13. A shaping pulley assembly, comprising:

a belt-drivable shaping pulley including at least one contacting surface;

a shaping pulley holder for releasably mounting the shaping pulley, the shaping pulley holder assembly, including:

a first and a second end bracket;

wherein the first end bracket includes a live centre, and wherein the second end bracket includes a live counter-centre;

wherein the live centre and rotatable live counter-centre are slidably movable with respect to each other in a manner to selectively mount the shaping pulley; and wherein the live centre and live counter-centre are rotatable with respect to the any one of the first and second end brackets;

and wherein the at least one contacting surface is configured to engage with any one of the center live centre and the live counter-centre.

14. The shaping pulley assembly of claim 13, wherein the drivable shaping pulley has at least two contacting surfaces and wherein one of the contacting surfaces is positioned at an end of the shaping pulley and another of the contacting surfaces is positioned with respect to the one of the contacting surfaces at an opposing end of the shaping pulley.

15. The shaping pulley assembly of claim 13, wherein one of the two contacting surfaces engages the live centre and the other of the contacting surfaces engages the movable live counter-centre.

16. The shaping pulley assembly of claim 13, wherein the live centre and live counter-centre include, a shaft;

at least one roller bearing configured in a manner to support the shaft and coupled to any one of the first and second end brackets;

wherein the roller bearing are coupled to the end brackets through at least one abutment shoulder and at least one spring retaining ring.

17. The shaping pulley assembly of claim 16, wherein the at least one roller bearing is retained by the at least one abutment shoulder and at least one spring retaining ring.

18. The belt notching machine of claim 13, further comprising:

a first housing mounted with respect to the first end bracket and wherein the live centre is coupled to the first end bracket through the first housing; and a second housing mounted with respect to the second end bracket and wherein the live counter-centre is coupled to the second end bracket through the second housing;

wherein the second housing includes a hollow cylindrical enlargement secured to the second end bracket.

19. The belt notching machine of claim 18, further comprising:

a cap internally threaded and securable to the cylindrical enlargement; and a cylindrical element slidable with respect to the second end bracket; wherein said cylindrical enlargement is externally threaded in a manner to selectively couple the cylindrical element to the second housing.

20. A method of selectively mounting a shaping pulley to a notching machine, comprising:

providing a live centre mounted with respect to the notching machine and a live counter-centre mounted with respect to the notching machine; wherein the live centre is slidably movable with respect to the notching machine and a live counter-centre mounting with respect to the notching machine; wherein the live centre is slidably movable with respect to the live counter-centre;

moving the live centre with respect to the notching machine in a manner to increase the distance between the live centre and a live counter-centre;

inserting the shaping pulley between the live centre and live counter-centre; and moving the live centre with respect to the notching machine in a manner to decrease the distance between the live centre and live counter-centre, thereby coupling the shaping pulley to the live centre and live counter-center.

* * * * *

UNITED STATES PATENT AND TRADEMARK OFFICE

CERTIFICATE OF CORRECTION

PATENT NO. : 7,044,844 B2
APPLICATION NO. : 10/969180
DATED : May 16, 2006
INVENTOR(S) : Alessandro Caporusso It is certified that error appears in the above-identified patent and that said Letters Patent is hereby corrected as shown below:

Column 5, line 42, replace "brackets" with --bracket--.

Column 5, line 44, replace "centre-centre" with --centre and counter-centre--.

Column 5, line 54, insert --is positioned with respect to the one of the contacting surfaces-- between "surfaces" and "at".

Column 6, line 11, replace "bearings" with --bearing--.

Column 6, line 18, insert --one-- between "any" and "of".

Column 7, line 15, replace "bearing" with --bearings--.

Column 8, lines 14-15, delete "notching machine and a".

Column 8, lines 15-18, delete "mounting with respect to the notching machine; wherein the live centre is slidably movable with respect to the live counter-centre".

Signed and Sealed this

Twenty-sixth Day of September 2006

JON W. DUDAS
*Director of the United States Patent and Trademark Office*